United States Patent [19]

Huffman

[11] 3,977,621

[45] Aug. 31, 1976

[54] DIFFERENTIAL DRIVEN REWINDER-UNWINDER

[75] Inventor: Harold Walter Huffman, Fairfield, Ohio

[73] Assignee: The Hamilton Tool Company, Hamilton, Ohio

[22] Filed: May 4, 1973

[21] Appl. No.: 357,391

[52] U.S. Cl. ..... 242/75.5; 242/75.51

[51] Int. Cl.² ..... B65H 23/20

[58] Field of Search ..... 242/75.51, 75.5, 67.1–67.5, 242/75.43, 75.44, 75.45, 75.47, 75.52, 75.53

[56] References Cited

UNITED STATES PATENTS

| | | | |
|---|---|---|---|
| 1,265,329 | 5/1918 | Henderson | 242/75.5 |
| 2,392,226 | 1/1946 | Butterworth et al. | 242/75.5 |
| 2,648,502 | 8/1953 | Trofimov | 242/75.5 |
| 2,753,128 | 7/1956 | Thomas et al. | 242/75.5 |
| 2,916,227 | 12/1959 | Bowen | 242/75.5 |
| 3,219,291 | 11/1965 | Huffman | 242/75.51 |
| 3,224,830 | 12/1965 | Mitchell | 242/75.5 X |
| 3,441,233 | 4/1969 | Defontenay | 242/75.5 |
| 3,555,774 | 1/1971 | Craig | 242/67.2 X |

FOREIGN PATENTS OR APPLICATIONS

| | | | |
|---|---|---|---|
| 1,221,956 | 2/1971 | United Kingdom | 242/75.53 |

*Primary Examiner*—Stanley N. Gilreath
*Assistant Examiner*—John M. Jillions
*Attorney, Agent, or Firm*—J. Warren Kinney, Jr.

[57] ABSTRACT

The rotational speed of the roll supporting shaft of a differential driven rewinder-unwinder is controlled whereby to substantially eliminate the generation of heat by utilizing a variable speed variable torque, regenerative motor-type drive in conjunction with a regenerative, multi-quadrant D.C. control. Current is generated and returned to the power lines during a part of each rewinding or unwinding cycle, thereby conserving energy.

26 Claims, 12 Drawing Figures

165
163
162
62
167
20
22
R
24
242
240
26
30
W
42
32
28
Q
184
192
224
190
44
198
222
46
48
163
50
52
165
162
180
186
220
M
54
210
R'
5
4
11

DIFFERENTIAL DRIVEN REWINDER-UNWINDER

BACKGROUND OF THE INVENTION

1. Field of the Invention

The invention relates to a device for rewinding or unwinding, under predetermined constant tension, a web of paper onto or from a roll.

REWINDER

By way of background and example, in the case of a rewinder, let it be assumed that the web speed of a printing press or the like is 1250 feet per minute, and that a rewound roll will be created from the web starting at 3¼ inch core diameter and finishing at a 50 inch diameter. Under these conditions the roll core shaft will require a maximum of 1480 rpm at the start, and when the roll has built up to a 50 inch diameter the roll core shaft will be operating at 97 rpm.

At the same time, the torque requirements at the roll core shaft, by way of example, will change from 100 inch pounds at the 3¼ inch diameter to 1525 inch pounds at the 50 inch diameter. It will, therefore, be seen that the prime mover which compensates for these changes in diameter and torque conditions is subject to the following ratio of change:

| | |
|---|---|
| R.P.M. | $\frac{1480}{97} = 15.25$ to 1 |
| Tension and resultant torque | $\frac{100}{1525} = 1$ to 15.25 |

From the foregoing it will be noted that the greatest torque is required for the lowest rpm, which is a condition which must be satisfied in all roll rewind applications. Heretofore a slip device has been utilized to accommodate the entire range of rotational speed of the roll core shaft, without aid of mechanical ratio change or relief from the heavy torque requirement at the lower speeds, with a result that the drive motors were in the 50–60 h.p. category. Motors of such size are inherently slow to respond to change and are, at best, insensitive.

UNWINDER

By way of background and example, let it be assumed that the web speed of a printing press or the like is 1250 feet per minute, and that a roll to be unwound will be 50 inch diameter to start and will finish at a 3¼ inch diameter. Under these conditions the roll core shaft will require a maximum of 97 rpm at the start, and when the roll has unwound to a 3¼ inch diameter the roll core shaft will be operating at 1480 rpm.

At the same time, the torque requirements at the roll core shaft, by way of example, will change from 1525 inch pounds at the 50 inch diameter to 100 inch pounds at th 3¼ inch diameter. It will, therefore, be seen that the prime mover which compensates for these changes in diameter and torque conditions is subject to the following ratio of change:

| | |
|---|---|
| R.P.M. | $\frac{1480}{97} = 15.25$ to 1 |
| Tension and resultant torque | $\frac{100}{1525} = 1$ to 15.25 |

From the foregoing it will be noted that the greatest torque is required for the lowest rpm, which is a condition which must be satisfied in all roll unwind applications. Heretofore a friction brake device has been utilized to accommodate the entire range of rotational speed of the unwind core shaft where the web has pulled the roll without aid of rotational power being applied to the unwind shaft.

The present invention is directed to a method of and means for improving the operating characteristics and efficiencies of a rewinder-unwinder of the differential driven type.

2. Description of the Prior Art

In my U.S. Pat. No. 3,219,291 entitled Differential Driven Rewinder, the roll core shaft was driven by the output of a differential having one input from the main drive shaft of the press and a second input in the form of an eddy current brake which provided a minus or negative factor to subtract revolutions from the differential to decrease the rate of rotation of the paper roll as its diameter increased.

The requirements for winding a roll of paper under constant tension are that as the roll diameter increases, the roational speed of the roll must decrease.

The rotational speed is inversely proportional to the roll diameter, and at the same time, as the roll increases in size under constant tension conditions of the web, the torque on the roll core or rewind shaft increases in proportion to the roll diameter.

The power requirements of the rewind shaft itself are the product of torque and speed. Since torque is increasing proportional to roll diameter and speed is inversely increased to roll diameter, the product or power required to wind the roll is constant from core size to full diameter.

In U.S. Pat No. 3,219,291 the requirements are such that the main drive shaft of the press inputted, to one leg of the differential, the maximum speed required for the minimum size of roll or core diameter and the second leg of the differential was required to dissipate, remove or compensate the excess speed as the roll diameter increased by means of an eddy current brake. It was necessary that the torque capacity of the eddy current brake be large enough to handle or accommodate rolls of maximum diameter, thus the braking arrangement was sized for the product of maximum speed and maximum torque. Since conditions of maximum speed and maximum torque do not exist at the same time the press was required to input into the differential the maximum power required to rotate the roll at core size, and the eddy current brake was utilized to dissipate the difference between this maximum power, which was the product of maximum speed and maximum torque minus the actual constant power required to wind the roll of paper.

In a device as described in the Background of the Invention, a press would typically input 40 h.p. into one leg of the differential of which only 2½ h.p. was actually required to wind the roll, leaving 37½ h.p. to be dissipated back into the press room as heat. This heat would have to be removed from the press room by mechanical or air-conditioning means.

In using the differential as disclosed in U.S. Pat. No. 3,219,291 the braking device developed its greatest torque at its highest r.p.m. thus reducing its size and capacity requirements so that sensitivity was retained and less electronic control was needed since one leg or input to the differential received power from the press drive, however, considerable heat was developed in the local or environmental area. This heat was removed from the press room by mechanical or air-conditioning means.

In sharp contrast thereto the D. C. motor of the subject invention does not develop or generate any appreciable heat during any phase of a rewinding or unwinding operation.

SUMMARY OF THE INVENTION

The present invention is directed to a differential rewinder or unwinder, and for purposes of clarity of detail and understanding the invention will be initially described in terms of a rewinder wherein the output of the differential which drives the roll core shaft is the sum of one input from the press and another input from a variable speed reversible regenerative motor which is operated part of the time as a motor and part of the time as a brake. Automatic gear ratio change means are incorporated in said motor drive whereby the actual amount of horsepower consumed in the system is approximately 2.5, disregarding minor friction losses. If, by way of example, a 10 h.p. variable speed, reversible D.C. motor is used, approximately 7½ h.p. is regenerated when the motor is operated as a brake, and through a conventional solid state control the 7½ h.p. is fed back to the electric supply lines for the drive to the printing press equipment. The resultant heat loss into the press room is negligible since as much as 50 h.p. is saved, first on the basic drain of the press lines and secondly by the fact that the brake action is converted into usable electric power instead of being dissipated as heat into the room.

A primary object of the invention is to utilize the differential principle disclosed in my U.S. Pat. No. 3,219,291 but wherein its capabilities have been greatly enhanced by using a regenerative motor type drive in place of the eddy current brake, thus generating current in part of the rewinding cycle thereby conserving energy.

A further object of the invention is to utilize the differential to its fullest capabilities. This is accomplished by means of a comparably small, low horsepower, variable speed, reversible D.C. electric motor which in the case of a rewinder initially inputs additional revolutions to one leg of the differential as the roll increases from core size to approximately 12 inches in diameter, at which time the D.C. motor input to the cage of the differential passes through zero and concurrently therewith rotation of the cage passes through zero as its initial direction of rotation is reversed as the size of the roll increases. A change of ratio occurs in the D. C. motor drive during the period of time when the cage of the differential passes through zero r.p.m. without effecting the tension of the web as the winding operation continues uninterruptedly. Thereafter, the cage of the differential will be driven from zero speed to its full rated speed as the roll buildup continues to full roll size, and during this phase of the operation, the D. C. motor is operated as a generator brake, being driven by the cage of the differential.

When the device is operated as an unwinder, the reversible D. C. electric motor initially subtracts excess revolutions from one leg of the differential by acting as brake as the roll decreases from full size, for example 50 inch diameter, to approximately 12 inches in diameter, at which time the D. C. motor input to the cage of the differential passes through zero and concurrently therewith rotation of the cage passes through zero as its initial direction of rotation is reversed as the size of the roll further decreases. A change of ratio occurs in the D. C. motor drive during the period of time when the cage of the differential cage passes through zero r.p.m. without effecting the tension of the web as the unwinding operation continues uninterruptedly. Thereafter, the cage of the differential will be driven from zero speed to its full rated speed as the unwound roll diameter decrease continues to core size, and during this phase of the operation, the D. C. motor is operated as a motor, driving the cage of the differential and adding revolutions to the one leg of the differential.

Another object of the invention is to utilize a variable speed reversible D. C. electric motor in both forward and reverse directions of its output shaft to a maximum speed of rotation in each direction, such as, by way of example, from 2,800 r.p.m. in one direction to zero r.p.m. and then from zero r.p.m. to 2,800 r.p.m. in the opposite direction for thereby creating a 5,600 r.p.m. differential without burdening the normal rating of the motor.

Another object of the invention is to utilize the features hereinabove described to appreciably reduce the high noise level normally associated with rewinding and/or powered unwinding operations.

An additional object of the invention is to utilize a relatively small regenerative drive motor which has inherently low inertia value ($WR^2$) thereby retaining a high degree of sensitivity when signaled for change.

PREFERRED EMBODIMENT OF THE INVENTION

Figures 1, 7, 9:
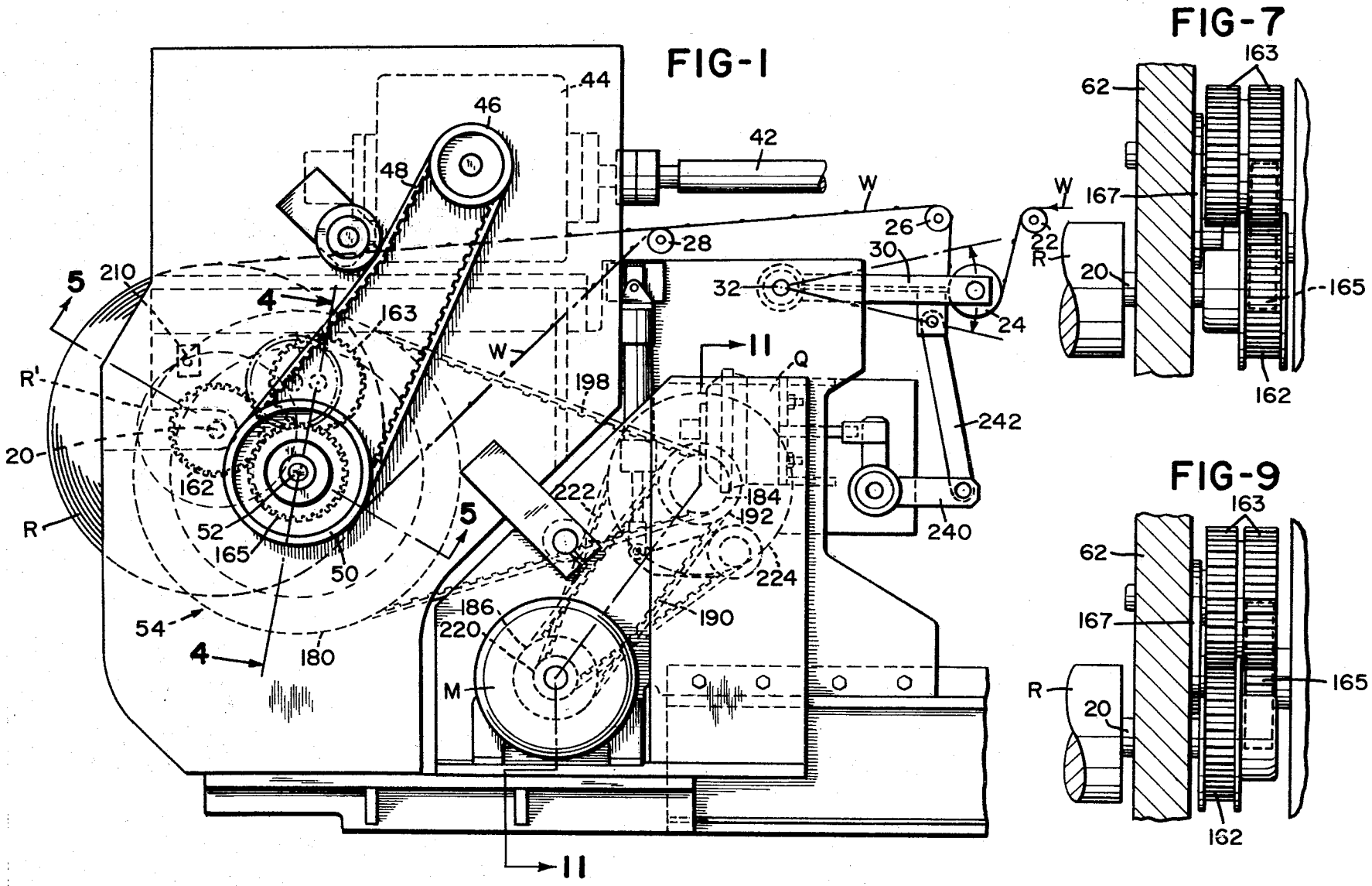
FIG. 1 is a side view of a rewinder-unwinder device embodying the teachings of the present invention.
FIG. 7 is a view on line 7—7 of FIG. 6.
FIG. 9 is a view taken on line 9—9 of FIG. 8.
Figure 2:
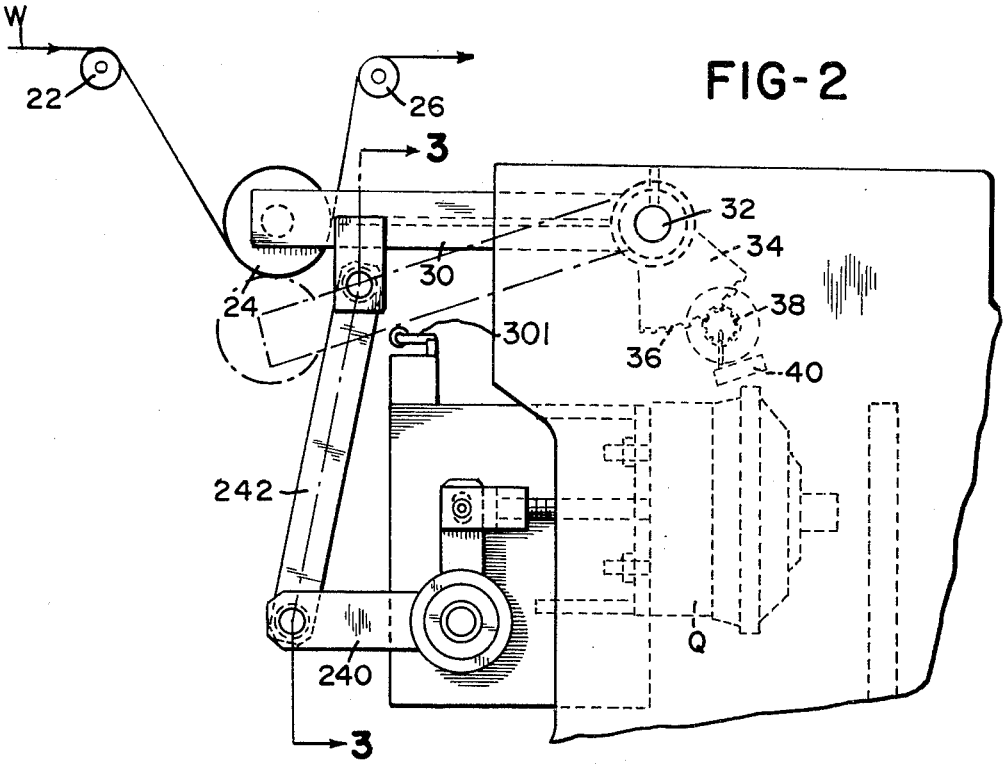
FIG. 2 is an expanded view of a portion of FIG. 1 showing the air loaded dancer device in greater detail.
Figure 3:
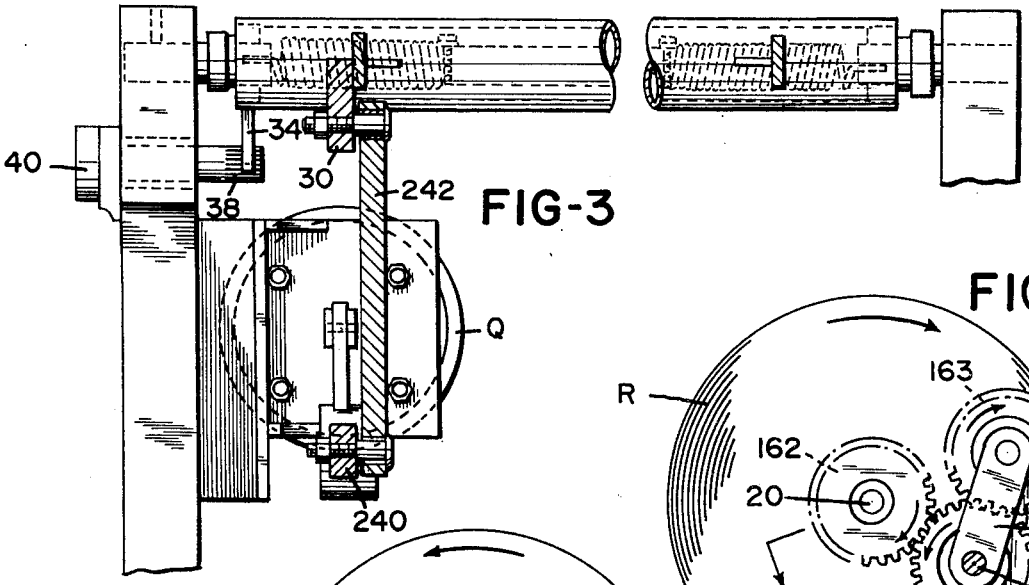
FIG. 3 is a sectional view on line 3—3 of FIG. 2.
Figure 6:
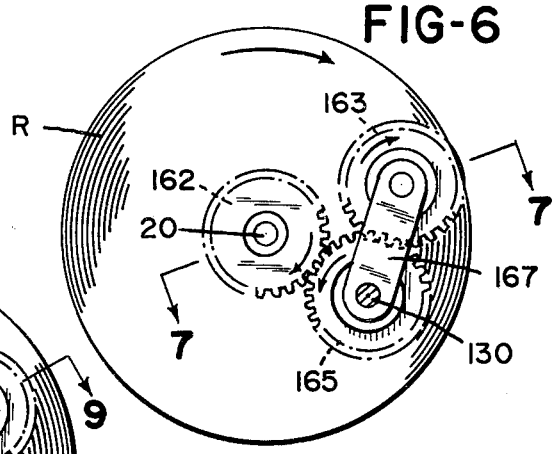
FIG. 6 is a view taken on line 6—6 of FIG. 5.
Figure 5:
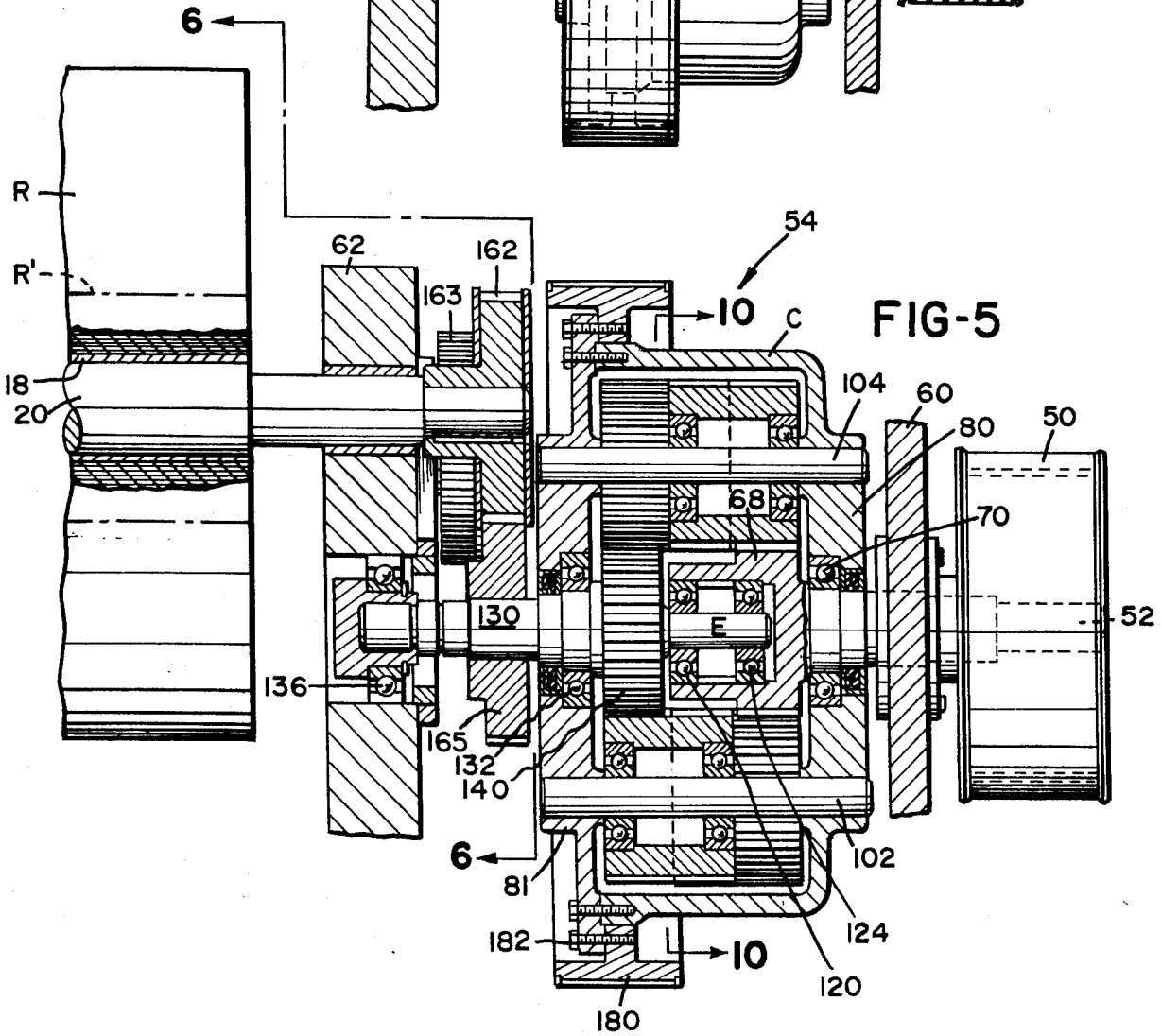
FIG. 5 is a sectional view taken on line 5—5 of FIG. 1 showing certain details of the differential.

With reference to FIGS. 1 and 2, the letter W denotes generally a continuous web of material which is being rewound on core 18 of core or winding shaft 20 of FIG. 5. The web is caused to pass over idler rollers 22, 24, 26, and 28 en route to the winding shaft. When operated as an unwinder, web W is unwound from shaft 20 over idler rollers 28, 26, 24 and 22 en route to a press, or the like, not illustrated.

Rollers 22, 26, and 28 extend tranversely of a pair of laterally spaced, conventional frame elements. Roller 24 is rotatably journalled to the outer portion of a dancer arm lever 30, the other end of which is mounted for movement about shaft 32. A segmental gear 34 (see FIG. 2) having gear teeth 36 is secured relative to lever 30 whereby to rotate about shaft 32 incident to movement of the outer end of the dancer arm lever 30. The gear teeth 36 of the segmental gear 34 engage the teeth of a gear 38 of a potentiometer indicated generally by the numeral 40.

The numeral 42 (FIG. 1) denotes generally the main drive shaft of a rotary press, said drive shaft being suitably driven by means (not illustrated), it being noted that the present invention is neither concerned with nor directed to the drive means for shaft 42 since said means are conventional and well known in the art.

The main drive shaft 42 inputs the press speed into a right angle hypoid gear box 44 and transmits rotation via pulley 46, belt 48, and input pulley 50 to the input pinion shaft 52 (see FIG. 4) of a differential indicated generally by the numeral 54.

Figure 4:
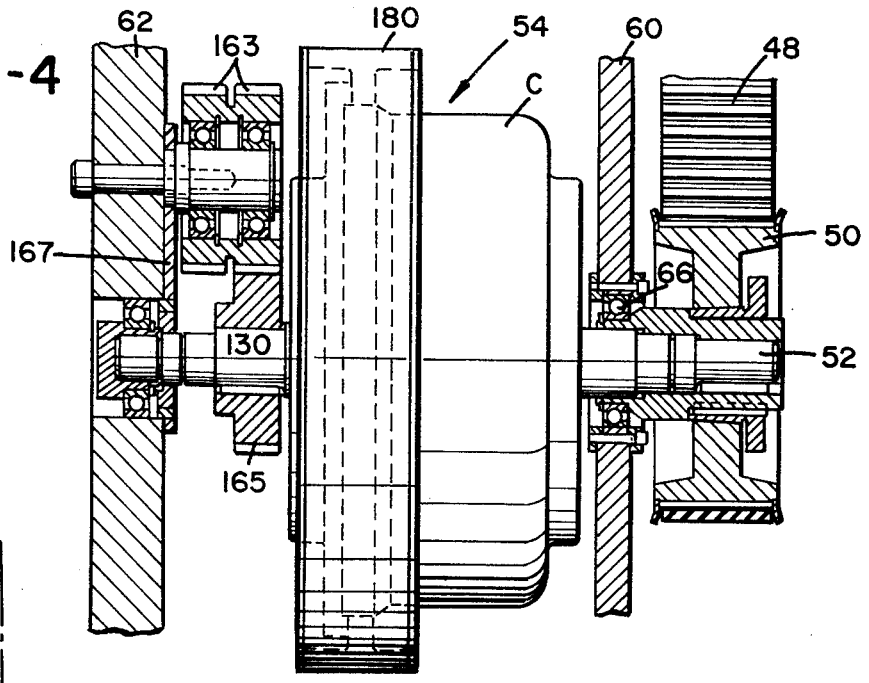
FIG. 4 is a view, partly in section, on line 4—4 of FIG. 1.

With particular reference now to FIGS. 4 and 5, the numerals 60 and 62 denote a pair of laterally spaced frame elements between which the differential 54 is mounted. Input pulley 50 is mounted in driving relationship with pinion shaft 52, which is rotatably journaled in bearings 66 relative to frame 60. An input pinion gear 68 is secured to or formed integral with the other end of shaft 52, said shaft being journaled as at 70 to wall 80 of the differential housing.

Figure 10:
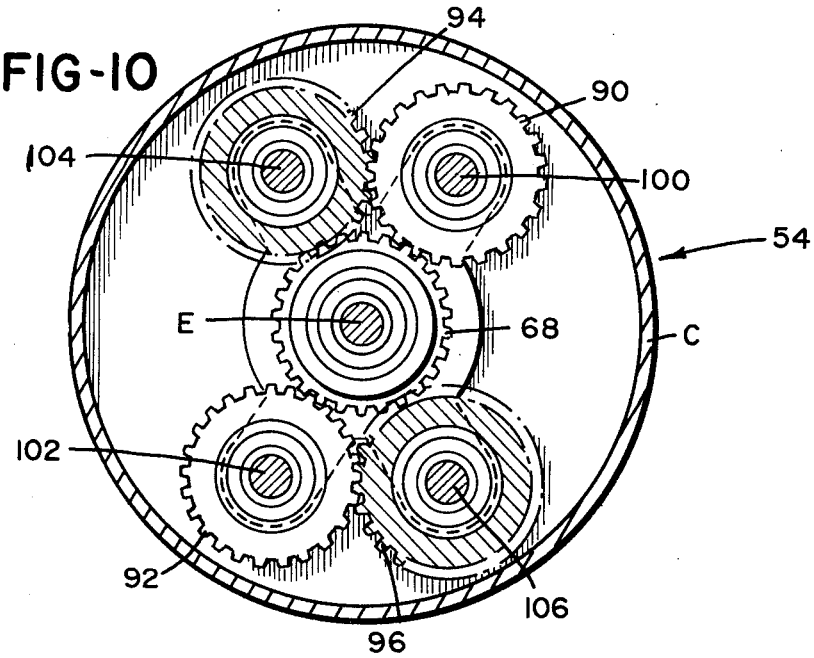
FIG. 10 is a view taken on line 10—10 of FIG. 5.

A plurality of sets of idler gears 90, 92, 94 and 96 are rotatably journaled on shafts 100, 102, 104 and 106 respectively, note FIGS. 5 and 10. The opposite ends of said shafts are secured to and carried by opposed walls 80 and 81 of the differential housing, which walls they span.

One end of input pinion gear 68 is axially recessed for accommodating bearing assemblies 120 and 124 by which end E of the output pinion shaft 130 is rotatably journaled relative to the pinion gear 68. An output pinion gear 140 is integral with or secured to and carried by shaft 130 which is rotatably journaled to wall 81 of the differential housing as by bearings 132.

Figure 8:
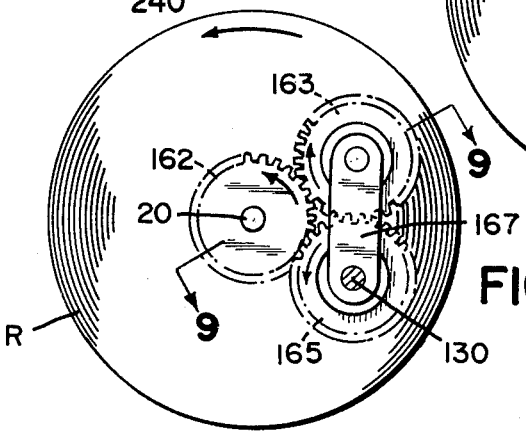
FIG. 8 is a view similar to FIG. 6 illustrating the relationship of the parts when the direction of rotation of the roll being rewound is reversed.

A gear 165 is secured in driven relationship with shaft 130, said gear being in driving relationship with gear 162 of the core shaft 20. Shaft 130 is also rotatably journaled relative to frame 62 by bearings 136. The direction of rotation of the core or winding-unwinding shaft 20 is determined by the position of idler gear 163 with respect to gears 165 and 162. FIGS. 8 and 9 illustrate the gear arrangement from the output gear 165 to idler gear 163 to rewind-unwind shaft gear 162 for causing the winding-unwinding shaft 20 to be rotated whereby to cause web W to be wound or unwound in a "face out" mode with a previously printed surface, denoted by the raised surface areas, to be on the outside of roll R.

In the preferred embodiment of the invention, the input from the main drive shaft 42 to the differential is suitably geared whereby to rotate a roll of paper R at a 12.1 inch diameter, rather than at a "core diameter" as in my U.S. Pat. No. 3,219,291.

In FIGS. 1 and 5, a 12.1 inch diameter of the roll is indicated by the reference character R′.

The housing of the differential is provided with a driving pulley, ring or gear 180 which circumscribes the differential cage C to which it is secured by means of bolts 182.

Figure 11:
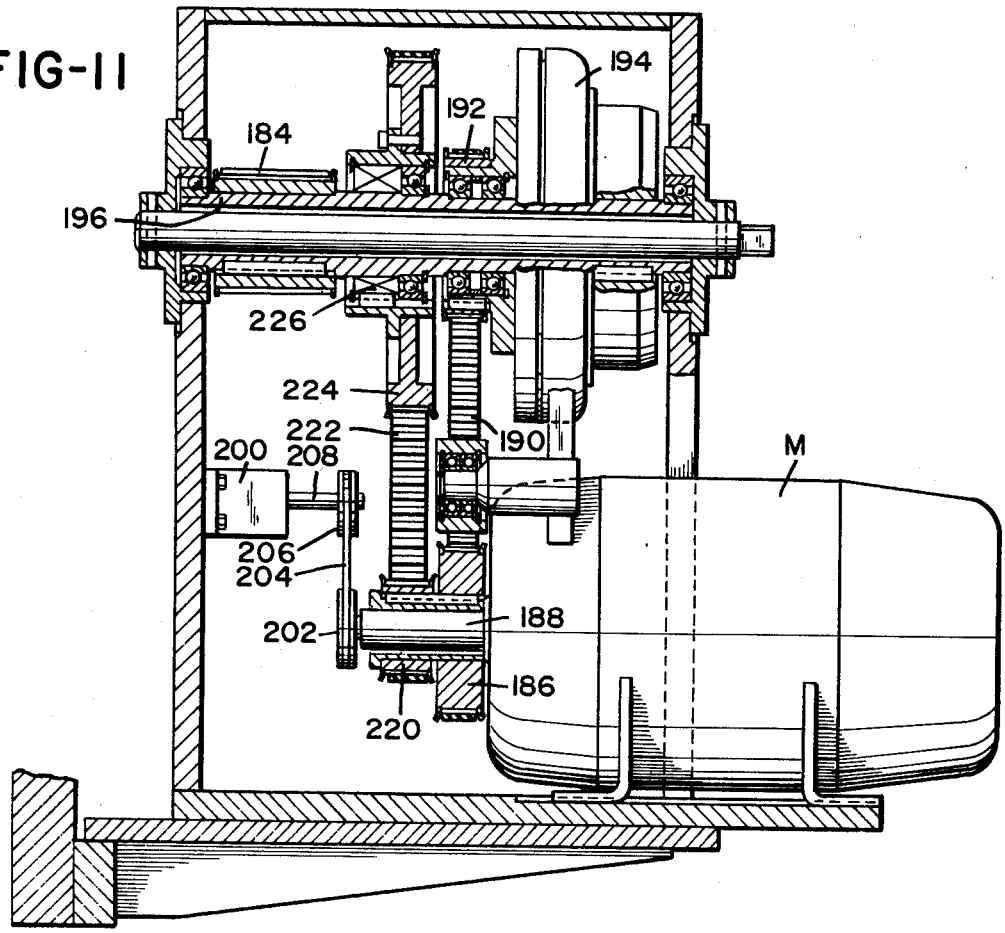
FIG. 11 is a view taken on line 11—11 of FIG. 1.

With reference to FIG. 11, a variable speed, reversible electric D. C. motor M is in direct driving relationship with pulley 184 via pulley 186 on motor shaft 188, belt 190, pulley 192 of an electromagnetic clutch 194 and jack shaft 196.

When operated as a rewinder, pulley 180 of the differential is in driven relationship with pulley 184 via belt 198, note FIG. 1. From core diameter up to 12.1 inch diameter R′ of the roll the rotational speed inputted to pulley 50 by the main press drive 42 is not sufficient to wind the roll of paper, therefore, motor M is caused to rotate in a positive direction for adding speed to the differential cage via pulley 180 causing the output 130 of the differential to rotate the roll of paper R at the arithmetic sum of input 52 from the press drive and input 180 from the D. C. motor M.

At a 12.1 inch diameter of the roll the input at 52 from the main press drive shaft 42 is sufficient to wind web W onto roll R without assistance from motor M. Therefore, the D. c. motor M comes to a stop and no longer adds rotation to the differential through cage C thereof via pulley 180.

As the diameter of the roll increases above a 12.1 inch diameter the speed of rotation from the main press drive shaft 42 is in excess of the requirements to wind the roll, whereupon motor M is caused to act as a brake being rotated in an opposite or negative direction. The negative or reverse rotation of cage C of the differential is imparted to motor M in which event the arithmetic sum of the differential input 52 and differential input 180 is less with the result that the rotational speed of output shaft 130 is less as the roll increases in size.

Whenever motor M is driven in a negative direction as a brake, it is caused to function as a generator and outputs D. C. current into a conventional regenerative four quadrant (or two quadrant) D. C. motor controller, which converts the D. C. current into an A. C. output which is fed back into the press power lines.

In order to minimize the size of the D. C. motor M, and its included regenerative control system, the motor is operated as a motor over a speed range of plus 2800 r.p.m. to 0 r.p.m. as a motor, and from 0 r.p.m. to minus 2800 r.p.m. as a generator, thereby effectively providing a 5600 r.p.m. difference without burdening the normal rated motor condition, as earlier noted.

In the preferred embodiment of the invention, motor M is in driven relationship with jack shaft 196 through a two-speed transmission.

On roll sizes from core diameter to 12.1 inch diameter the jack shaft 196 is driven by motor M, pulley 186, belt 190, pulley 192 of an electromagnetic clutch 194 which is suitably energized whereby to be in driven relationship with the jack shaft 196 as hereinabove set forth. Under these conditions the ratio between pulleys 186 and 192 are on a 1:1 basis, and under these conditions of operation, because the roll diameter is small, the low torque but high speed conditions required for adding rotation to differential cage C are satisfied.

When the roll attains a 12.1 inch diameter, R′, FIG. 1, the speed of motor M approaches zero. Zero speed of the motor is sensed by a zero speed switch denoted generally by the numeral 200 which is in driven relationship with shaft 188 of motor M via pulley 202, belt 204, and pulley 206 on the zero speed switch shaft 208.

An electric eye 210 is suitably positioned, as illustrated in FIG. 1, whereby to sense and indicate when the roll has attained a 12.1 inch diameter, R′.

On roll sizes from 12.1 inch to 50 inch diameter it will be noted (see FIG. 11) that shaft 188 of motor M is connected via pulley 220, belt 222, pulley 224 of a one way clutch 226 which is in one way driving relationship with jack shaft 196.

Figure 12:
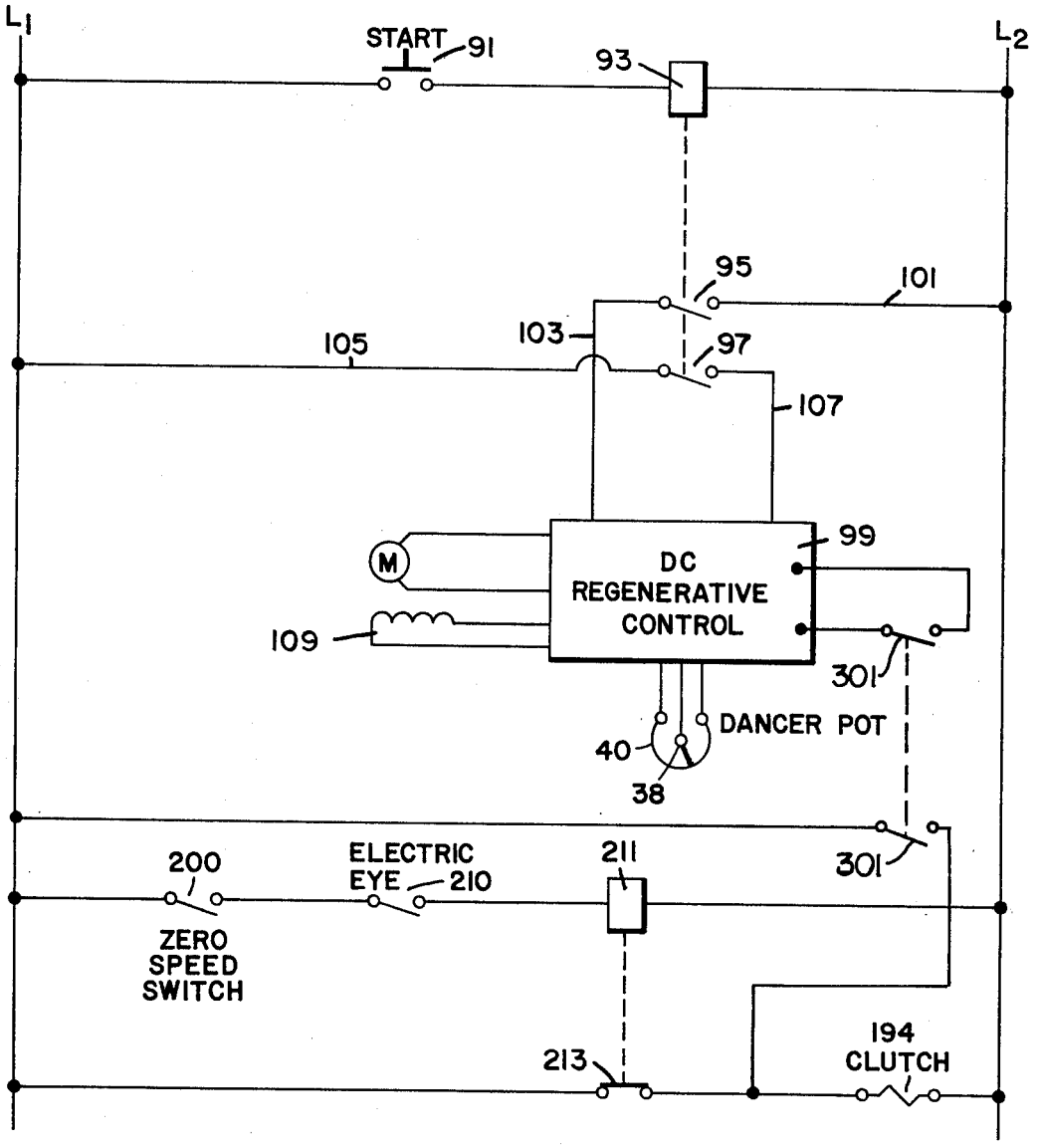
FIG. 12 is a wiring circuit of certain electric units which are utilized in shifting the drive ratio of the electric motor when the cage of the differential passes through zero rotation during the rewind of a roll.

With particular reference now to FIG. 12, it will be noted that the zero speed switch 200, the electric eye 210 and solenoid 211 are connected in series circuit with power lines L1 and L2. Electromagnetic clutch 194 is connected across lines L1 and L2 whereby to be normally energized. From the foregoing, it will be noted that upon attainment of zero motor speed and 12.1 inch diameter roll solenoid 211 will be energized thereby opening switch 213 for breaking the circuit to the magnetic clutch 194 thereby de-energizing same. When cluth 194 is de-energized the motor M will be in driven relationship with jack shaft 196 through one way clutch 226, one way pulley 224, belt 222 and pulley 220.

De-energization of electromagnetic clutch 194 occurs when the rotational speed of roll R equals the rotational input speed of the main press drive shaft 42 to the differential, at which time cage C of the differential passes through zero rotation in one direction to rotation in an opposite direction during the uninterrupted rewind of the roll. The driving means illustrated in FIG. 11 are utilized, in the present example, from a roll size of 12.1 inch diameter up to its full size of 40, 50, or 60 inches, during those periods of time when a 5:1 reduction is established between pulley 220 and pulley 224. This ratio reduction effectively minimizes the frame size and torque requirements of motor M.

In order to further minimize the size of D. C. motor M, and its included regenerative control system, it is operated as a motor generator over a speed range of plus 2800 to 0 r.p.m. as a motor and from 0 to minus 2800 r.p.m. as a brake. This enables the D. C. motor to be operated in an armature control mode only and minimizes the complexity of the D. C. controller.

When operated as an unwinder the one way clutch 226 is reversed. Pulley 180 of the differential is in driven relationship with pulley 184 via belt 198, note FIG. 1. From full diameter down to 12.1 inch diameter R′ of the roll the rotational speed inputted to pulley 50 by the main press drive 42 is excess to unwind the roll of paper, therefore, motor M is caused to rotate in a negative direction for subtracting speed from the differential cage via pulley 180 causing the output 130 of the differential to rotate the roll of paper R at the arithmetic sum of input 52 from the press drive and input 180 from the D. C. motor M.

At a 12.1 inch diameter of the roll being unwound the input at 52 from the main press drive shaft 42 is sufficient to unwind web W from roll R without assistance from motor M. Therefore, the D. C. motor M comes to a stop and no longer subtracts rotation from the differential through cage C thereof via pulley 180.

As the diameter of the roll decreases from a 12.1 inch diameter the speed of rotation from the main press drive shaft 42 is insufficient for the requirements to unwind the roll, whereupon motor M is caused to act as a motor being rotated in an opposite or positive direction. The positive rotation of cage C of motor M is imparted to the differential in which event the arithmetic sum of the differential input 52 and differential input 180 is greater with the result that the rotational speed of output shaft 130 is greater as the roll decreases in size.

On roll sizes from 12.1 inch diameter to core diameter the jack shaft 196 is driven by motor M, pulley 186, belt 190, pulley 192 of an electromagnetic clutch 194 which is suitably energized whereby to be in driven relationship with the jack shaft 196 as hereinabove set forth. Under these conditions the ratio between pulleys 186 and 192 are on a 1:1 basis, and under these conditions of operation, because the roll diameter is small, the low torque but high speed conditions required for adding rotation to differential cage C are satisfied.

When the roll reduces to a 12.1 inch diameter, R′, FIG. 1, the speed of motor M approaches zero. Zero speed of the motor is sensed by a zero speed switch denoted generally by the numeral 200 which is in driven relationship with shaft 188 of motor M via pulley 202, belt 204, and pulley 206 on the zero speed switch shaft 208.

On roll sizes from 50 to 12.1 inch diameter it will be noted (see FIG. 11) that shaft 188 of motor M is connected via pulley 220, belt 222, pulley 224 of a one way clutch 226 which is in one way driving relationship with jack shaft 196.

With particular reference now to FIG. 12, it will be noted that the zero speed switch 200, the electric eye 210 and solenoid 211 are connected in series circuit with power lines L1 and L2. Electromagnetic clutch 194 is connected across lines L1 and L2 whereby to be normally energized. From the foregoing, it will be noted that upon attainment of zero motor speed and 12.1 inch diameter roll solenoid 211 will be de-energized thereby closing switch 213 for completing the circuit to the magnetic clutch 194 thereby energizing the same.

Energization of electomagnetic clutch 194 occurs when the rotational speed of roll R equals the rotational input speed of the main press drive shaft 42 to the differential, at which time cage C of the differential passes through zero rotation in one direction to rotation in an opposite direction during the uninterrupted unwind of the roll. The driving means illustrated in FIG. 11 are utilized, in the present example, from a roll size of 40, 50 or 60 inch diameter down to 12.1 inch diameter during those periods of time when a 5:1 reduction is established between pulley 220 and pulley 224. This ratio reduction effectively minimizes the frame size and torque requirements of motor M.

DANCER ARM

The speed of D.C. Motor M whether acting as a motor or generator is regulated to maintain dancer arm 30 in the mid-position of its range of travel. The resistance of potentiometer 40 is varied as dancer arm 30 moves through its arc of action. The output of potentiometer 40 is fed into a standard regenerative D.C. motor controller 99, FIG. 12, to establish the proper speed of D.C. motor M acting as a motor and/or as a generator to maintain the desired tension of web W and to maintain dancer arm 30 at its mid-point position.

If dancer arm 30 drops below its mid-position when or while the device is operated as a rewinder, it indicates that roll R is not being rotated fast enough to take up web W coming from the press. This will cause D.C. motor M to act as a motor and input positive rotation to differential cage C.

On the other hand, if dancer arm 30 rises above its mid-position it signifies that roll R is rotating too rapidly. This will cause motor M to act as a generator and to slow down roll R.

In practice, from an initial core diameter up to 12.1 inch diameter, the D.C. motor M is called upon to add rotation to roll R, however, it may overshoot and actually correct as a brake in order to maintain dancer 30 at its mid-position. However, above 12.1 inch diameter, the D. C. motor is continuously called upon to subtract rotation from cage C, thus jack shaft 196 is driving through one-way clutch 226 to pulley 224 to belt 222 to pulley 220 to drive D.C. motor M as a generator. One-way clutch 226 will not permit the D.C. motor M to add positive rotation in the opposite direction as it will merely "override" or slip. To drive in this direction is not necessary as from 12.1 inch diameter to full roll diameter it is necessary to constantly take speed out of or from differential cage C.

If dancer arm 30 drops below its mid-position when or while the device is operated as an unwinder, it indicates that roll R is being rotated too fast for web W to be taken by the press. This will cause D.C. motor M to act as a brake cage.

On the other hand, if dancer arm 30 rises above its mid-position it signifies that roll R is rotating too slowly. This will cause motor M to act as a motor and input additional positive rotation to differential cage C to speed up roll R.

In practice, from full roll diameter down to 12.1 inch diameter, the D.C. motor M is called upon to continuously subtract rotation from cage C, thus jack shaft 196 is driving through one-way clutch 226 to pulley 224 to belt 222 to pulley 220 to drive D.C. motor M as a generator. One-way clutch 226 will not permit the D.C. motor M to add positive rotation in the opposite direction as it will merely "override" or slip. To drive in this direction is not necessary as from full roll diameter to 12.1 inch diameter it is necesssary to constantly take speed out of or from differential cage C.

In operation of the device an operator will set a pressure regulator, (not illustrated) to a given pressure which is established in an air cylinder Q, thus creating the desired or proper tension in web W. This tension is achieved by the dancer arm assembly creating the proper amount of wattage through a powerstat, not illustrated, to the D.C. motor M. The dancer arm 30 will find a position in its range of travel that causes the appropriate signal to be sent to motor M to satisfy a pre-determined tension in web W as set by the operator through the air pressure regulator.

With reference to FIG. 12, it will be noted that when switch 91 is closed solenoids 93 will be energized thereby closing each of switch arms 95 and 97 for completing an electric circuit to motor M through the D.C. regenerative control 99 via conductors 101, 103, 105 and 107. The numeral 109 denotes generally the field control of motor M which is in series circuit with the potentiometer 40, reference being had to FIG. 2 for a disclosure of the means by which gear 38 of the potentiometer is actuated by movement of dancer arm lever 30.

EMERGENCY STOP

In the event of a web breakage in the press, or otherwise, it becomes desirable, if not necessary, to stop rotation of roll R as rapidly as possible. Rapid stopping of the roll is particularly necessary in those instances in which the roll diameter exceeds 12.1 inch and wherein the inertia of the rotating roll overrides the one way clutch 226 and allows the roll to rotate freely in its mounts.

With reference to FIGS. 2 and 12, the numeral 301 designates a web break switch which is activated when the dancer arm drops to the lowered position indicated in broken outline in FIG. 2.

Actuation of switch 301 causes clutch 194 to be energized with full operating voltage while simultaneously causing the regenerative drive 99 to be driven to zero speed with maximum torque. This "boxes" belts 222 and 190 causing the inertia of the roll R to be dissipated by slipping clutch 194 under its full volt energization.

What is claimed is:

1. The method of utilizing a regenerative multi-quadrant D.C. control in combination with a dancer-arm controlled potentiometer and a variable torque, variable speed, reversible D.C. motor to control the torque and rotational speed of the roll support shaft of a differential rewinder-unwinder when rewinding a continuous web of material under predetermined tension into a roll on said roll support shaft, or when unwinding a continuous web of material under predetermined tension from a roll on said roll support shaft;

wherein the required rotational speed of the roll support shaft is such that the peripheral speed of a roll of material on said roll support shaft, at all diameters of said roll, is equal to the surface speed at which the web of material is being wound onto or unwound from the roll, and wherein the differential has an output and two inputs and wherein the arithmetic sum of the rotational speeds of the two inputs to the differential equals the rotatonal speed of the output which determines the rotational speed of the roll support shaft driven thereby, which method comprises the steps of:

a. rotating one input to the differential at a predetermined rotational speed which is less than the required rotational speed of the roll support shaft at core roll size and which is greater than the required rotational speed of the roll support shaft at full roll size, b. utilizing variations in the web-supported position of the dancer-arm to vary the resistance of the potentiometer for regulating the output of the regenerative control to said motor for controlling the rotational speed of the other input to the differential for selectively and variably augmenting or opposing the rotational speed of said first input whereby to maintain the said required rotational speed or torque of the roll support shaft during the rewinding of material onto or from said shaft.

2. A method as called for in claim 1, which includes the steps of initially rotating other said input to the differential in one direction at an ever decreasing rotational speed or torque during a rewinding operation for selectively augmenting the rotational speed of said one input until the rotational speed inputed by said one input is, per se, substantially equal to the required rotational speed of the roll support shaft; and then controlling the said other input to the differential wherein it is rotated in an opposite direction and at ever increasing rotational speeds or torque for opposing the rotational speed of said one input until the roll attains full size.

3. A method as called for in claim 2, which includes the steps of initially rotating said other input to the differential in one direction at an ever decreasing rotational speed or torque during a rewinding operation for selectively augmenting the rotational speed of said one input until the rotational speed inputed by said one input is, per se, substantially equal to the required rotational speed of the roll support shaft for a roll intermediate core and full size, at which time the rotational speed inputed by said other input passes through zero rotational speed; and then controlling the said other input to the differential whereby it is rotated in an opposite direction and at ever increasing rotational speeds or torque for opposing the rotational speed inputed by said one input for imparting the required rotational speed to the roll support shaft as the roll being rewound attains full size.

4. A method as called for in claim 3, which includes the step of changing the drive ratio between said motor and the said other input to the differential from a first ratio during those periods of time when the said other input is operated to augment the rotational speed inputed by the one input, to a different ratio during those periods of time when the said other input is operated to oppose the rotational speed inputed by said one input.

5. A method as called for in claim 4, wherein said first ratio is substantially less than the second mentioned ratio.

6. A method as called for in claim 1, which includes the steps of initially rotating said other input to the differential in one direction at an ever decreasing rotational speed or torque during an unwinding operation for selectively opposing the rotational speed of said one input until the rotational speed inputed by said one input is, per se, substantially equal to the required rotational speed of the roll support shaft; and then controlling the said other input to the differential whereby it is rotated in an opposite direction and at ever increasing rotational speeds or torque for augmenting the rotational speed of said one input until the roll is reduced in diameter to core size.

7. A method as called for in claim 6, which includes the step of initially rotating said other input to the differential in one direction at an ever decreasing rotational speed or torque during an unwinding operation for selectively opposing the operational speed of said one input until the rotational speed inputed by said one input is, per se, substantially equal to the required rotational speed of the roll support shaft for a roll intermediate full and core size at which time the rotational speed inputed by said other input passes through zero rotational speed, and then controlling the said other input to the differential whereby it is rotated in an opposite direction and at ever increasing rotational speeds of torque for imparting the required rotational speed to the roll support shaft as the roll being unwound attains core size.

8. A method as called for in claim 7, which includes the step of changing the drive ratio between said motor and the said other input to the differential from a first ratio during those periods of time when the said other input is operated to oppose the rotational speed inputed by said one input, to a different ratio during those periods of time when said other input is being operated to augment the rotational speed inputed by said one input.

9. A method as called for in claim 8, wherein said first ratio is substantially greater than the second mentioned ratio.

10. A method as called for in claim 1, which includes the steps of initially rotating said motor and other input to the differential in one direction at an ever decreasing rotational speed or torque during a rewinding operation for selectively augmenting the rotational speed of one first input until the rotational speed inputed by said one input is, per se, substantially equal to the required rotational speed of the roll support shaft, and thereafter rotating said motor and said other input to the differential in an opposite direction and at ever increasing rotational speeds or torque for opposing the rotational speed of said one input until the roll attains full size.

11. A method as called for in claim 10, which includes the steps of driving the other input by said motor during those periods of time when the said other input is augmenting the rotational speed of the one input, and driving said motor by the other input during those periods of time when the said other input is opposing the rotational speed of the one input.

12. A method as called for in claim 11, wherein said motor operates as a D.C. generator during those periods of time when it is being driven by the said other input.

13. A method as called for in claim 12, which includes the steps of converting the generated D.C. current to A.C. current, and of feeding said A.C. current back to the power lines.

14. A method as called for in claim 1, which includes the steps of initially rotating said motor and other input to the differential in one direction at an ever decreasing rotational speed or torque during an unwinding operation for selectively opposing the rotational speed of said one input until the rotational speed inputed by said one input is, per se, substantially equal to the required rotational speed of the roll support shaft, and rotating said motor and said other input to the differential in an opposite direction at ever increasing rotational speeds or torque for augmenting the rotational speed of said one input until the roll is reduced in diameter to core size.

15. A web winding-unwinding machine including a drive shaft; a roll support shaft; a differential transmission intervening said shaft, wherein said transmission includes two input members and an output shaft; means driving said roll support shaft from said output shaft; means driving the first differential input member from said drive shaft at a predetermined, substantially constant rotational speed which is less than the required rotational speed of the roll support shaft at core roll size and which is greater than the required rotational speed of the roll support shaft at full roll size, wherein the required rotational speed of the roll support shaft is that rotational speed at which the peripheral speed of a roll of material being wound onto or unwound from the roll support shaft is, for all diameters of the roll, equal to the surface speed at which material is fed to or removed from the roll under predetermined tension; a variable torque, variable speed, reversible electric D.C. motor; means for controlling the rotational speed of said motor as a function of a predetermined tension on the material during rewind or unwind; means operable for providing a driving relationship between said motor and said second differential input member during those periods of time when the rotational speed of the first differential input member is less than the required rotational speed of the roll support shaft for a given diameter of a roll on said winding shaft; and other means operable for providing a driven relationship of said motor by said second differential input member during those periods of time when the rotational speed of the first differential input is greater than the required rotational speed of the roll support shaft, thereby increasing or decreasing the rotational speed imparted to said output shaft by the first differential input member whereby to rotate the roll support at required rotational speeds.

16. A machine as called for in claim 15, which includes means to establish a tension-control loop in a web of material being wound onto or unwound from said roll support shaft, said means including a pair of web-supporting rolls and a web-supported dancer roll intermediate said web-supporting rolls, wherein the position of said dancer roll is responsive to changes in tension in said web; variable voltage control means to vary the electric control of said motor; and means imparting changes in the position of the dancer roll to said variable voltage control means to selectively control the torque and rotational speed transmitted to said roll support shaft by the second differential input member.

17. A machine as called for in claim 16, wherein the variable voltage control means comprises a regenerative, multi-quadrant D.C. control unit.

18. A machine as called for in claim 15, which includes control means operable for rotating said motor at substantially full speed in one direction when initially in driving relationship with said second differential input member when the roll being wound on said roll support shaft is core size, and thereafter progressively decreasing the rotational speed of said motor through zero r.p.m. as the diameter of the roll on said shaft increases to such size that the rotational speed of the first differential input member approaches and then equals the required rotational speed of the roll support shaft, and means operable as said motor speed passes through zero r.p.m. for placing said motor in driven relationship with said second differential input member whereby said motor is driven in an opposite direction at rotational speeds progressively increasing from zero r.p.m. to substantially full speed as the diameter of the roll on said roll support shaft increases to full size.

19. A machine as called for in claim 18, wherein the second differential input member augments the first differential input member when the motor is in driving relationship with the second differential input member, and wherein the second differential input member opposes the first differential input member when the motor is in driven relationship with the second differential input member.

20. A machine as called for in claim 18, wherein the motor is a motor-generator adapted for converting torque into electrical energy when in driven relationship with said second differential input member.

21. A machine as called for in claim 15, which includes control means operable for rotating said motor at substantially full speed in one direction when initially in driven relationship with said second differential input member when the roll being unwound from said roll support shaft is full size, and thereafter progressively decreasing the rotational speed of said motor through zero r.p.m. as the diameter of the roll on said shaft decreases to such size that the rotational speed of the first differential input member approaches and then equals the required rotational speed of the roll support shaft, and means operable as said motor speed passes through zero r.p.m. for placing said motor in driving relationship with said second differential input member whereby said motor is rotated in an opposite direction at rotational speeds progressively increasing from zero r.p.m. to substantially full speed as the diameter of the roll on said roll support shaft decreases to core size.

22. A machine as called for in claim 15, which includes means establishing a first drive ratio between the motor and the second differential input during those periods of time when said input is operated to augment the rotational speed inputed by said first differential input, and means establishing a second different drive ratio between the motor and second differential input during those periods of time when said second input is operated to oppose the rotational speed inputed by said differential input.

23. A machine as called for in claim 15, which includes a pair of different, independently operable drive ratios, and means selectively establishing a driving relationship between the motor and the second differential input member through one or the other of said ratios.

24. A machine as called for in claim 23, wherein the means for selectively establishing a driving relationship between the motor and the second differential input member through one or the other of said ratios constitutes means responsive to a zero speed condition of the second differential input when the speed inputed by the first differential input is, per se, substantially equal to the required rotational speed of the roll support shaft.

25. A machine as called for in claim 24, which includes an electromagnetic clutch, and means controlled by said electromagnetic clutch, for selectively establishing a driving relationship through one of said ratios when said clutch is engaged and the other of said ratios when said clutch is disengaged, wherein the said means responsive to a zero speed condition of the second differential input is adapted for selectively engaging and disengaging said clutch.

26. A machine as called for in claim 25, which includes means in series circuit with said zero speed responsive means and the electromagnetic clutch, wherein said means is reponsive to the size of a roll of material on said roll support shaft when the rotational speed inputed by the first input is, per se, substantially equal to the required rotational speed of the roll support shaft.

* * * * *